US011976451B2

(12) United States Patent
Kim

(10) Patent No.: US 11,976,451 B2
(45) Date of Patent: May 7, 2024

(54) FOOT SWITCH FOR TOILET BOWL

(71) Applicant: Geun Young Kim, Hwaseong-si (KR)

(72) Inventor: Geun Young Kim, Hwaseong-si (KR)

(73) Assignee: Geun Young Kim, Hwaseong-si (KR)

( * ) Notice: Subject to any disclaimer, the term of this patent is extended or adjusted under 35 U.S.C. 154(b) by 0 days.

(21) Appl. No.: 17/704,477

(22) Filed: Mar. 25, 2022

(65) Prior Publication Data

US 2022/0349166 A1 Nov. 3, 2022

(30) Foreign Application Priority Data

Apr. 28, 2021 (KR) ..... 20-2021-0001341
Feb. 7, 2022 (KR) ..... 20-2022-0000372

(51) Int. Cl.
*E03D 5/08* (2006.01)

(52) U.S. Cl.
CPC ..... *E03D 5/08* (2013.01)

(58) Field of Classification Search
CPC ..... E03D 5/08; F16K 31/465; F16K 31/62; E03C 1/052; A47K 13/10
See application file for complete search history.

(56) References Cited

U.S. PATENT DOCUMENTS 5,068,925 A * 12/1991 Salibi ..... E03D 5/08 4/405
6,089,542 A * 7/2000 Caravella ..... F16K 31/465 251/294

FOREIGN PATENT DOCUMENTS

| | | | |
|---|---|---|---|
| JP | 2004156412 | A | 6/2004 |
| KR | 2019990036062 | U | 9/1999 |
| KR | 101021439 | B1 * | 3/2011 |
| KR | 101468104 | B1 | 12/2014 |
| KR | 2020210000298 | U | 2/2021 |

* cited by examiner

*Primary Examiner* — Erin Deery
(74) *Attorney, Agent, or Firm* — Dinsmore & Shohl LLP; Yongsok Choi, Esq.

(57) ABSTRACT

A foot switch for driving a lever-type flush valve of a toilet bowl includes a lever operating part mounted on a flush valve of a toilet bowl to rotate a lever of the flush valve, a driving cable of which one end is connected to the lever operating part and the other end is connected to a foot stepper, and a foot stepper configured to pull the driving cable by being pressed by a foot of a user, wherein the lever operating part includes a first frame fixed to the flush valve and a second frame configured to be supported to be rotatable relative to the first frame as the driving cable is pulled.

11 Claims, 16 Drawing Sheets

PRIOR ART

FOOT SWITCH FOR TOILET BOWL

CROSS-REFERENCE TO RELATED APPLICATIONS

This application claims priority to Korean Patent Application No. 20-2021-0001341 filed on Apr. 28, 2021 and Korean Patent Application No. 20-2022-0000372 filed on Feb. 7, 2022, the entire contents of which are herein incorporated by reference.

TECHNICAL FIELD

The present device relates to a foot switch for driving a lever-type flush valve of a toilet bowl. More particularly, the present device relates to a foot switch for toilet bowls capable of operating a flush valve for toilet bowls with a foot without structural changes in or damage to the flush valve for toilet bowls or equipment around a toilet bowl, by using the structure of an existing flush valve for toilet bowls as it is.

BACKGROUND ART

In general, flush toilet bowls in public rest rooms adopt a structure of flushing water by pressing down or raising a lever by hand. For example, as shown in FIG. 1, a flush valve 2 for toilet bowls is installed on a pipe 1 extending upwards from the rear of a toilet bowl, and the flush valve 2 for toilet bowls is provided with a lever 3 disposed in a horizontal direction in a normal state. The lever 3 is pressed down or raised by a user to operate the flush valve 2. However, because many users touch the lever 3 of the flush valve 2, hygiene is not good, and there is a risk of actual exposure to bacteria. In particular, social demand for non-contact is increasing due to recent COVID-19 situations.

PRIOR ART DOCUMENTS

Patent Document (Patent document 1) KR 20-1999-0036062

SUMMARY

Technical Problem

The present device is designed to solve the problems of the related art, and therefore the present device is directed to providing a foot switch for toilet bowls capable of protecting a user from various virus dangers such as COVID-19 and enabling even a patient having difficulty in upper body movement to easily operate a flush valve, by additionally providing a function of driving a flush valve for toilet bowls with a foot without giving a sense of incompatibility when selecting an existing function of driving, by a user, a flush valve by raising and lowering a lever with hand.

The present device is also directed to providing a foot switch for toilet bowls that may be easily installed without any structural change in or damage to a flush valve for existing toilet bowls or equipment around a toilet bowl.

The present device is also directed to providing a foot switch for toilet bowls that is easy in maintenance even with frequent use, by providing a foot switch for toilet bowls that has a simple structure and is easy for non-experts to assemble and disassemble without the aid of a special tool.

The present device is also directed to providing a foot switch for toilet bowls having a low probability of failure even in toilet bowl and toilet environments that require frequent water cleaning.

Technical Solution

According to an embodiment of the present device, there is provided a foot switch for driving a lever-type flush valve of a toilet bowl includes a lever operating part mounted on a flush valve of a toilet bowl to rotate a lever of the flush valve, a driving cable of which one end is connected to the lever operating part and the other end is connected to a foot stepper, and a foot stepper configured to pull the driving cable by being pressed by a foot of a user, wherein the lever operating part includes a first frame fixed to the flush valve and a second frame configured to be supported to be rotatable relative to the first frame as the driving cable is pulled.

According to an embodiment of the present device, the second frame may be an arm, the arm may be configured to rotate relative to the first frame as the driving cable is pulled, and the arm may be rotated to contact the lever to push and rotate the lever. The lever operating part may include a housing at least partially surrounding the first frame and the second frame, and the housing may have a lower portion that is open to be mounted on the flush valve from top to bottom. The arm may be located inside the housing in a state where the driving cable is not pulled, and the arm may protrude from the housing as the driving cable is pulled and the arm is rotated. The housing may include a guide groove. As the arm rotates, the arm may move along the guide groove. The housing may include a lever groove enabling the lever to protrude out of the housing, and respective lower portions of the guide groove and the lever groove may be opened.

According to an embodiment of the present device, the second frame may be configured to wrap the lever and be fixed to the lever, the second frame may be configured to rotate relative to the first frame as the driving cable is pulled, and the second frame may be rotated to rotate the lever fixed to the second frame.

The second frame may include a lever hole forming an opening into which the lever is inserted, and a coupling hole formed along the periphery of the opening, and each of the lever hole and the coupling hole may extend along a lengthwise direction of the second frame. An opening extending in a lengthwise direction may be formed in the second frame.

A diameter of the lever hole may increase in a direction away from an opening into which the lever is inserted in the lengthwise direction of the second frame. The second frame may include a pair of protrusions each extending downward adjacent to the opening into which the lever is inserted, and a hole may be formed in each of the protrusions, and a guide pin may be fixedly fitted into the hole.

The first frame may include a guide hole, and, when the second frame is pulled by the driving cable and rotated relative to the first frame, the guide pin may move within the guide hole and maintain a contact support state with the guide hole.

According to an embodiment of the present device, the driving cable may include an inner cable and an outer cable surrounding the inner cable, and the inner cable may be movable within the outer cable, and the inner cable may be connected to the second frame so that the second frame is rotated as the inner cable is pulled.

According to an embodiment of the present device, the lever operating part may further include a housing, and at least a portion of the second frame may be exposed to the outside through an opening formed in the housing so that a user operates the lever by pressing the second frame.

According to an embodiment of the present device, the foot stepper may include a base plate, a pedal seated on the base plate, and an operating member connected to the driving cable and slidably disposed in front and rear directions of the base plate within the base plate. As the pedal is pressed downward, a protrusion formed on a lower surface of the pedal may move downward and come into contact with the seating surface of the operating member to push the operating member in the front and rear directions.

Advantageous Effects

According to an embodiment of the present device, no mechanical device for driving a lever is exposed around the lever until a user steps on a pedal by foot, and thus a function of operating the lever with the foot may be additionally provided while giving no sense of incompatibility when selecting an existing function of driving, by a user, a flush valve by raising or lowering the lever by hand.

According to an embodiment of the present device, it is sufficient that a lever operating part of a foot switch is fixed to the flush valve, and there is no additional needs to fix components (e.g., a driving cable) of the foot switch to the floor or wall around a toilet bowl, and thus additional construction on the floor or wall is unnecessary and the floor or the wall is not damaged.

According to an embodiment of the present device, each of the components of the foot switch has a simple structure and is thus easy to assemble and disassemble. Because users frequently use a flush value of a toilet bowl in terms of a function of the flush valve, replacement of specific parts and maintenance thereof are easy due to such easy disassembly and assembly.

DETAILED DESCRIPTION

The present device will now be described more fully with reference to the accompanying drawings, in which exemplary embodiments of the device are shown. The present device may, however, be embodied in many different forms and should not be construed as being limited to the embodiments set forth herein.

The terminology used herein is for the purpose of describing particular embodiments only and is not intended to limit the present device. As used herein, the singular forms "a", "an" and "the" are intended to include the plural forms as well, unless the context clearly indicates otherwise.

It will be understood that the terms "comprises" and/or "comprising," when used in this specification, specify the presence of stated components, steps, operations, and/or elements thereof, but do not preclude the presence or addition of one or more other components, steps, operations, and/or elements thereof.

While such terms as "first", "second", etc., may be used to describe various components, such components must not be limited to the above terms. The above terms are used only to distinguish one component from another. In the description, certain detailed explanations of the related art are omitted when it is deemed that they may unnecessarily obscure the essence of the present device.

Hereinafter, the present device will be described more fully with reference to the accompanying drawings, in which exemplary embodiments of the device are shown. The configuration of the present device and the effect of the action thereof will be clearly understood through the following detailed description.

Figure 1:
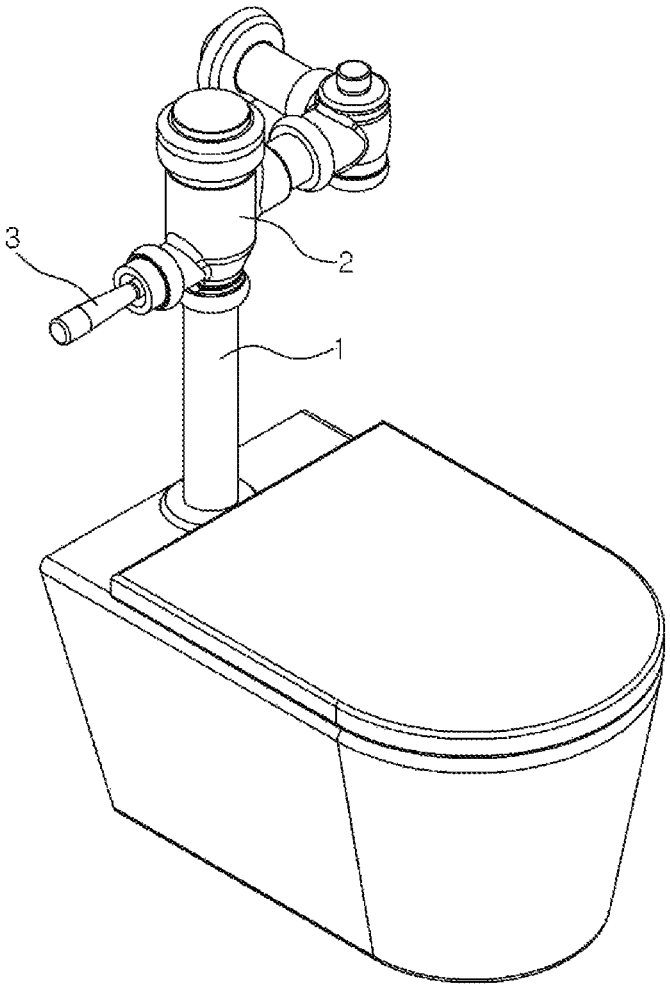
FIG. 1 is a perspective view of a toilet bowl including a lever-type flush value that is used in a typical public rest room.
Figure 2:
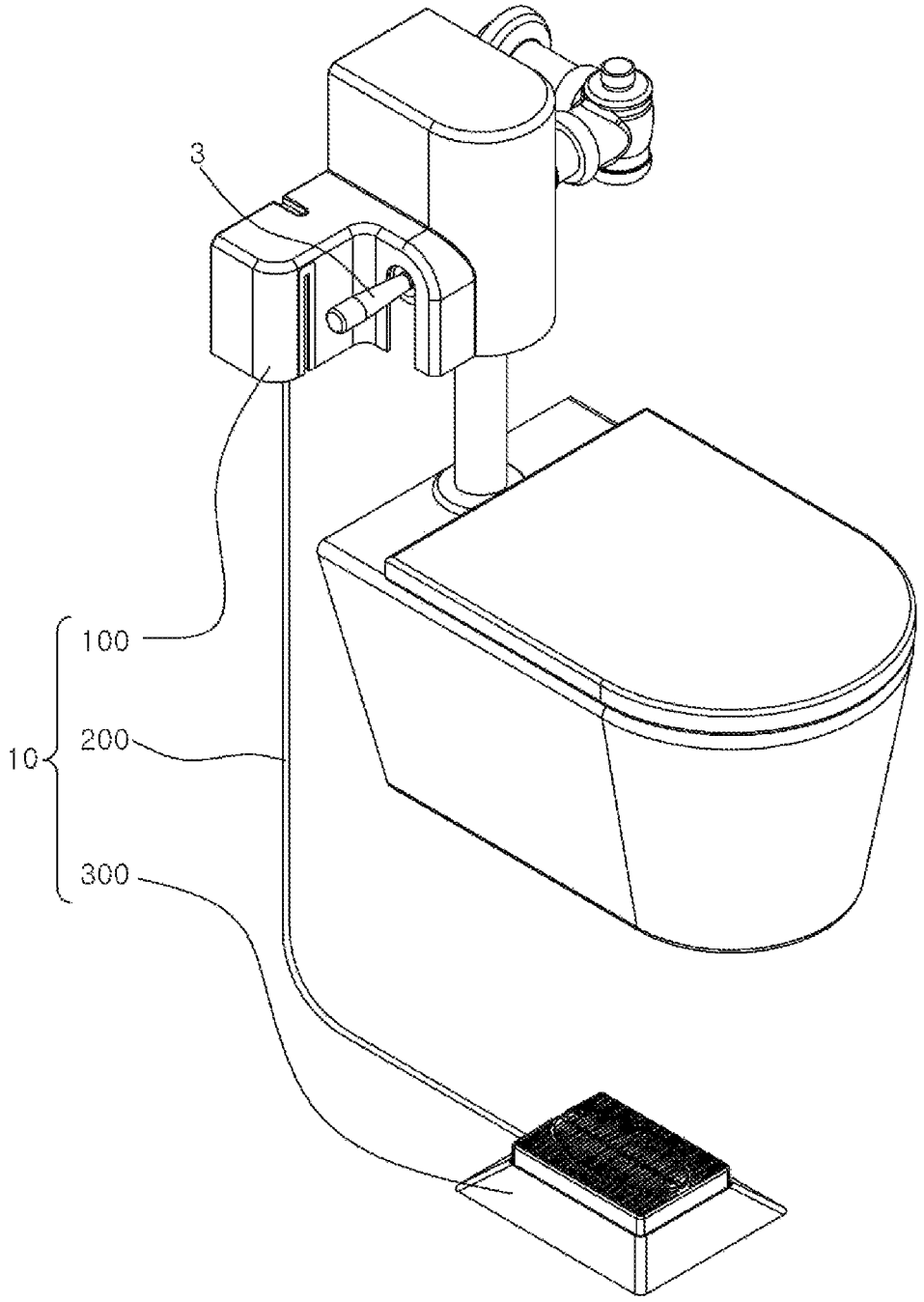
FIG. 2 is an exemplary view of a toilet bowl provided with a foot switch according to the first embodiment of the present device.

FIG. 2 is a perspective view of a toilet bowl provided with a foot switch according to a first embodiment of the present device. Referring to FIG. 2, a foot switch 10 according to a first embodiment of the present device may include a lever operating part 100, a driving cable 200, and a foot stepper 300. Through this foot switch 10, a user may operate a flush valve 2 by stepping on a pedal 340 of the foot stepper 300 with his or her foot, while the user may still operate the flush valve 2 by raising or lowering a lever 3 by his or her hand.

A more detailed description thereof will now be given below with reference to the drawings.

Figure 3:
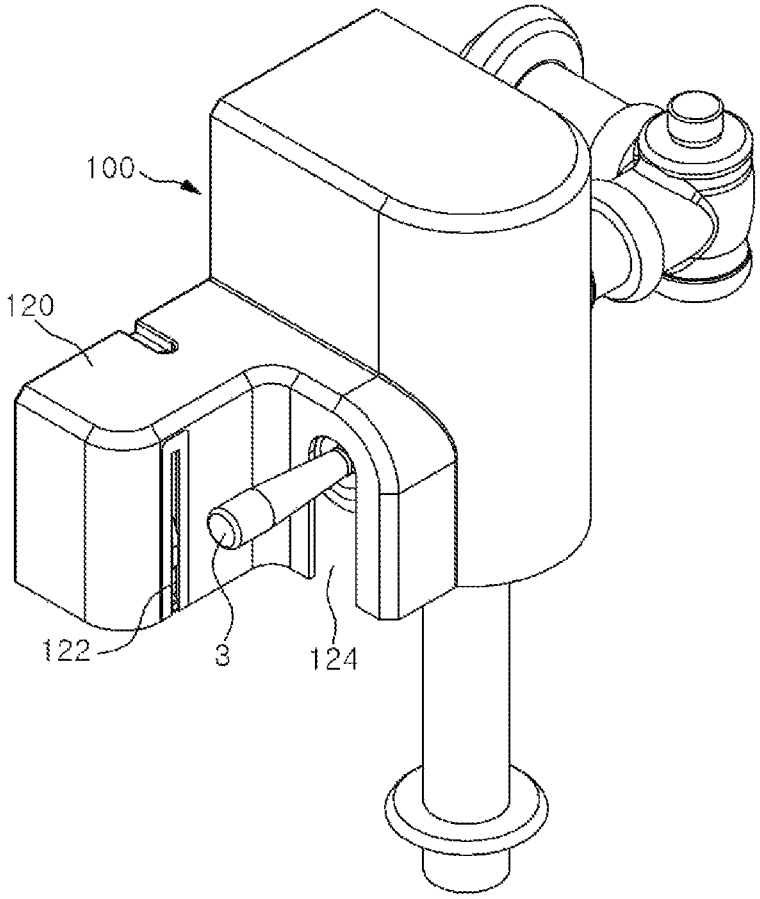
FIG. 3 is a perspective view of a lever operating part in a state where its arm is not rotated, according to the first embodiment of the present device.
Figure 4:
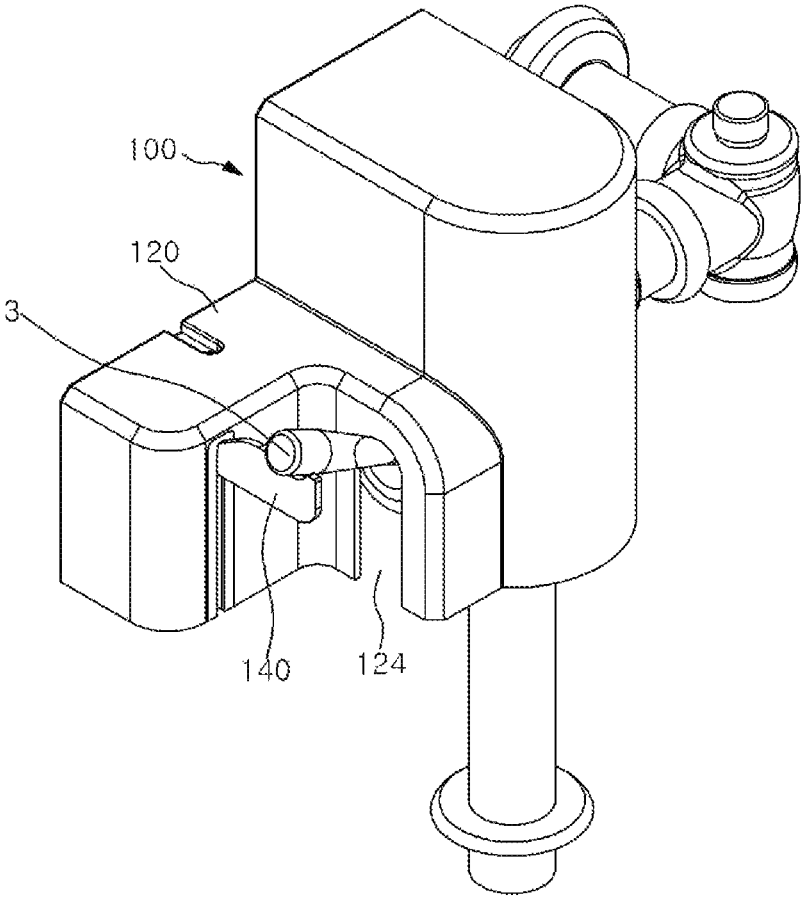
FIG. 4 is a perspective view of a lever operating part in a state where its arm is rotated and a lever has been pushed up, according to the first embodiment of the present device.

FIG. 3 is a perspective view of a lever operating part in a state where its arm is not rotated, according to the first embodiment of the present device. FIG. 4 is a perspective view of a lever operating part in a state where its arm is rotated and a lever has been pushed up, according to the first embodiment of the present device.

As can be seen from FIGS. 3 and 4, the lever operating part 100 includes a first frame 160 fixed to the flush valve 2, and a second frame 140 configured to be supported rotatably with respect to the first frame 160 as the driving cable is pulled. In the first embodiment, the second frame 140 is an arm.

The second frame 140 is inside a housing 120, and, only when the user steps on the pedal 340 of the foot stepper 300 with his or her foot, the second frame 140 is rotated to protrude from the housing 120 and pushes the lever 3 upwards. Through this structure, as shown in FIG. 3, even when the foot switch 10 is mounted on the flush valve 2, no mechanical devices or instruments are exposed around the lever 3 of the flush valve 2 until the user steps on the pedal 340 of the foot stepper 300. (As will be described later), while the foot switch 10 according to an embodiment of the present device adopts only a mechanical structure without using any electronic device such as a motor, no mechanical devices for driving the lever 3 are exposed around the lever 3 until the user steps on the pedal 340 of the foot stepper 300, and accordingly, the user does not feel a significant difference from a typical toilet bowl in which the foot switch 10 is not installed. Thus, without giving a sense of discomfort when the user selects an existing function of operating the flush valve 2 by raising or lowering the lever 3 by hand, a function of operating the lever 3 with the user's foot may be additionally provided.

Figure 5:
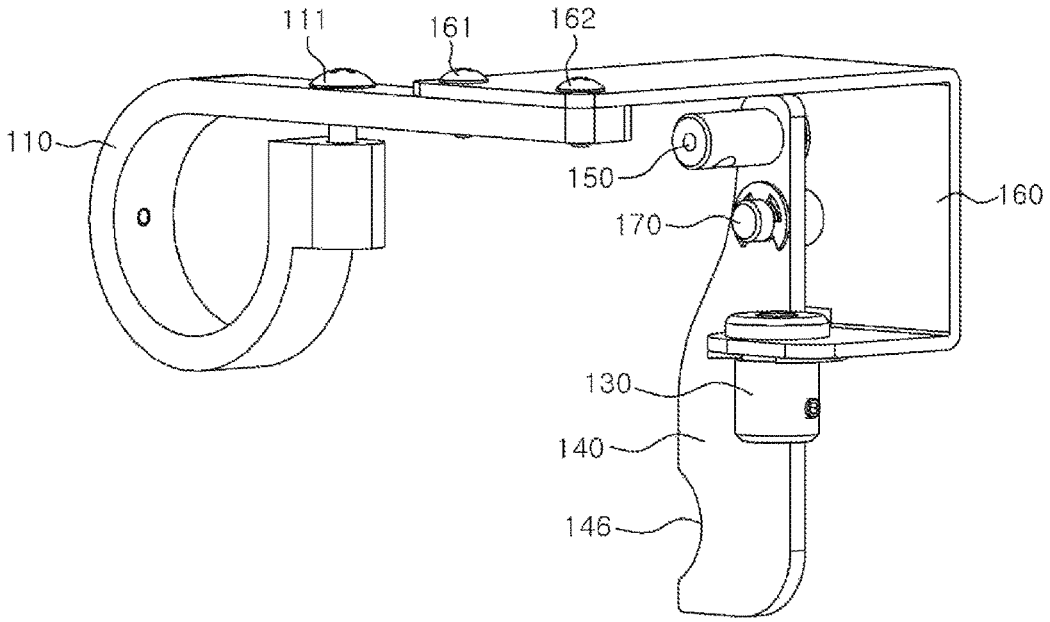
FIG. 5 is a perspective view of the lever operating part (from which a housing has been removed), according to the first embodiment of the present device.

FIG. 5 is a perspective view of the lever operating part 100 (from which the housing 120 has been removed), according to the first embodiment of the present device. The lever operating part 100 includes the first frame 160 fixed to the flush valve 2, and the second frame 140 configured to rotate relative to the first frame 160 as the driving cable 200 is pulled. The second frame 140 is an arm, and the arm is rotated to contact the lever 3 and push the lever 3 to rotate the lever 3. As shown in FIG. 5, a seating groove 146 may be formed at a location with which the lever 3 comes into contact during rotation of the second frame 140. The first frame 160 and the second frame 140 may be manufactured with steel.

The lever operating part 100 may further include a first fixing member 110 for fixing the first frame 160 to the flush valve 2, and a second fixing member 130 for fixing an end of the driving cable 200 to the first frame 160.

Figure 6:
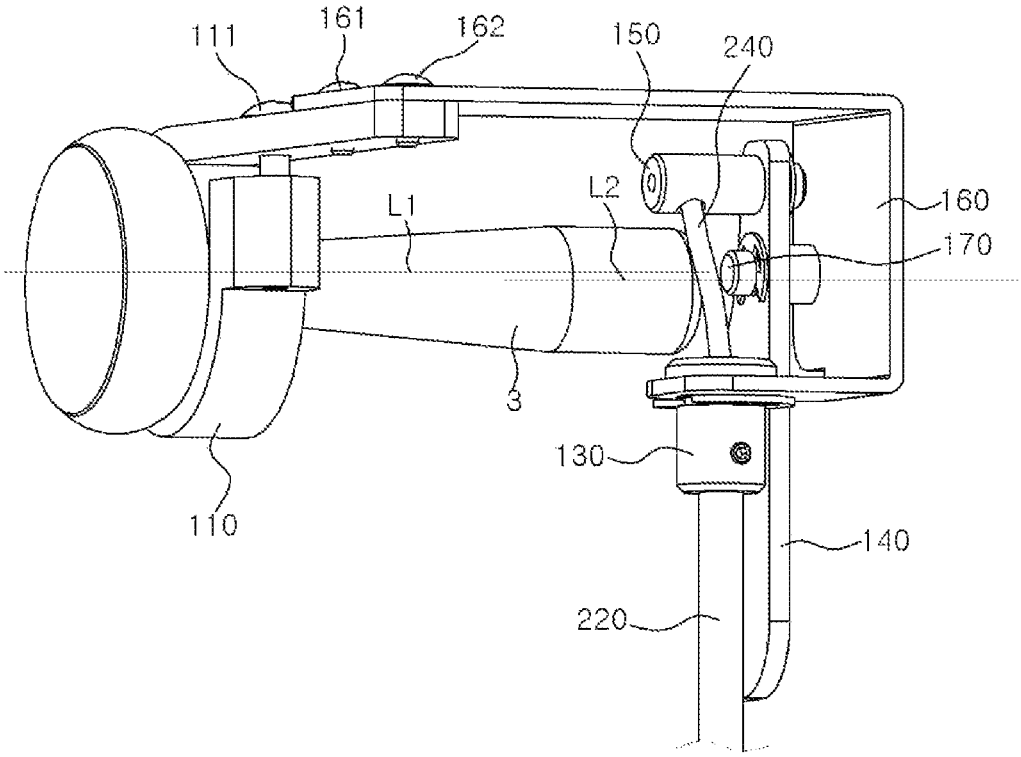
FIG. 6 is a perspective view of the lever operating part in a state of being mounted on a flush valve, according to the first embodiment of the present device.

The first fixing member 110 may be, for example, a metal band made of aluminum having a predetermined ductility. FIG. 6 is a perspective view of a lever operating part in a state of being mounted on a flush valve, according to an embodiment of the present device. As shown in FIG. 6, one end of the first fixing member 110 may be fixed to the first frame 160 through screws 161 and 162, and the first fixing member 110 may surround the flush valve 2 and then be tightened with a screw 111 to fix the first frame 160 to the flush valve 2.

Figure 7:
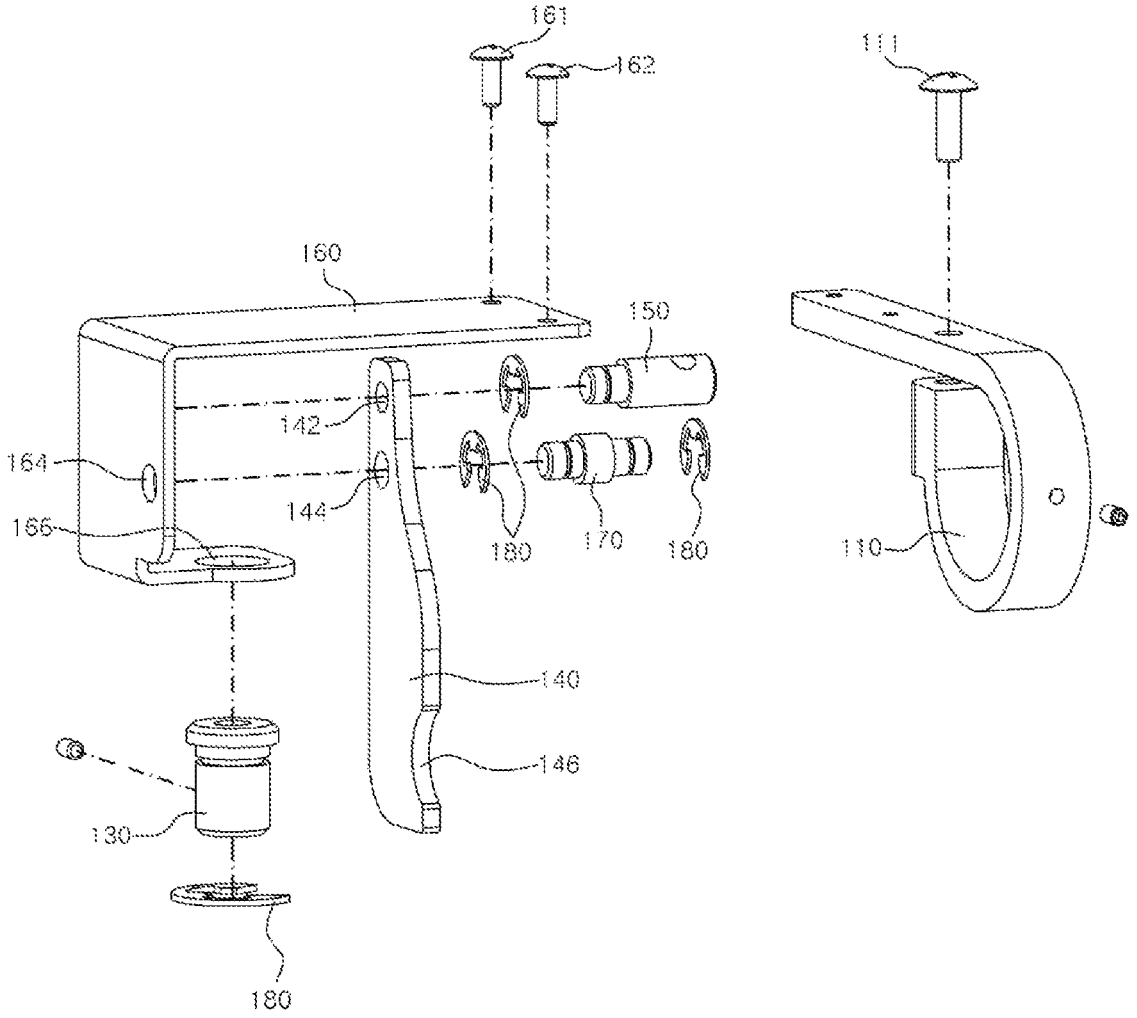
FIG. 7 is an exploded perspective view of the lever operating part according to the first embodiment of the present device.

FIG. 7 is an exploded perspective view of the lever operating part 100 according to the first embodiment of the present device. A rotation shaft 170 is inserted into a hole 144 of the second frame 140 and a hole 164 of the first frame 160, so that the second frame 140 is rotatably coupled with the first frame 160. As shown in FIG. 6, a direction L2 of the rotation shaft 170 of the second frame 140 is parallel to a lengthwise direction L1 of the lever 3 in a non-actuated state. At one end of the second frame 140, a protruding pin 150 is coupled to a hole 142 of the second frame 140 so as to extend parallel to the rotation shaft 170 of the second frame 140. A hole 166 is formed at an end of the first frame 160, and the second fixing member 130 is fixedly fitted into the hole 166. The second fixing member 130 may have a cylinder shape having a hollow, and the driving cable 200 may be fitted onto the hollow and fixed to the hole 166. When the second frame 140 is coupled with the protruding pin 150 and the rotation shaft 170 and the second fixing member 130 is coupled with the first frame 160, a fixing packing 180 may be used for fixing.

The driving cable 200 has a double-track cable structure and may be composed of an inner cable 240 and an outer cable 220 surrounding the inner cable 240, and the outer cable 220 may be, for example, a sheathed wire. The inner cable 240 is movable within the outer cable 220. As shown in FIG. 5, the outer cable 220 may be fixedly fitted into the hollow of the second fixing member 130, and the inner cable 240 may further extend from the outer cable 220 and may be fixed to the protruding pin 150 through a hole formed in the protruding pin 150. Accordingly, when the inner cable 240 is pulled, the second frame 140 is rotated about the rotation shaft 170.

Through the above-described structure (that is, the double-track cable structure and the structure in which one end of the outer cable 220 is fixed at a predetermined point through the lever operating part 100 attached to the flush valve 2), the driving cable 200 does not need to maintain a taut state. In other words, even when the driving cable 200 does not maintain a taut state, the inner cable 240 is pulled so that the second frame 140 is rotated. For example, when the driving cable 200 has a single-wire structure, unless the driving cable 200 is in a taut state, the second frame 140 may not rotate even when the driving cable 200 is pulled. Therefore, additional fixtures for keeping the driving cable 200 taut are needed around a toilet bowl (e.g., on the floor or wall), and thus additional construction may be needed on the floor or wall and the floor or wall may be damaged.

As shown in FIG. 3, a guide groove 122 is formed in the housing 120, and, as the second frame 140 rotates, it moves along the guide groove 122. A lever groove 124 enabling the lever 3 to protrude from the housing 120 is formed in the housing 120. A lower portion of the housing 120 is open so that the housing 120 may be mounted on the flush valve 2 from the top to the bottom, and respective lower portions of the guide groove 122 and the lever groove 124 are also open. Through the above-described structure, without needing to disassemble or change the existing flush valve 2, the lever operating part 100 may be easily installed on the flush valve 2 by fixing the first frame 160 to the flush valve 2 through the first fixing member 110 and then covering the first frame 160 with the housing 120. On the other hand, by removing the housing 120 and releasing the first fixing member 110 from the flush valve 2, the lever operating part 100 may be easily removed from the flush valve 2. Because the lever operating part 100 is frequently used by users according to the function of the flush valve 2 of a toilet bowl, such easy attachment/detachment, disassembly, and assembly facilitate replacement of specific parts.

Figure 8:
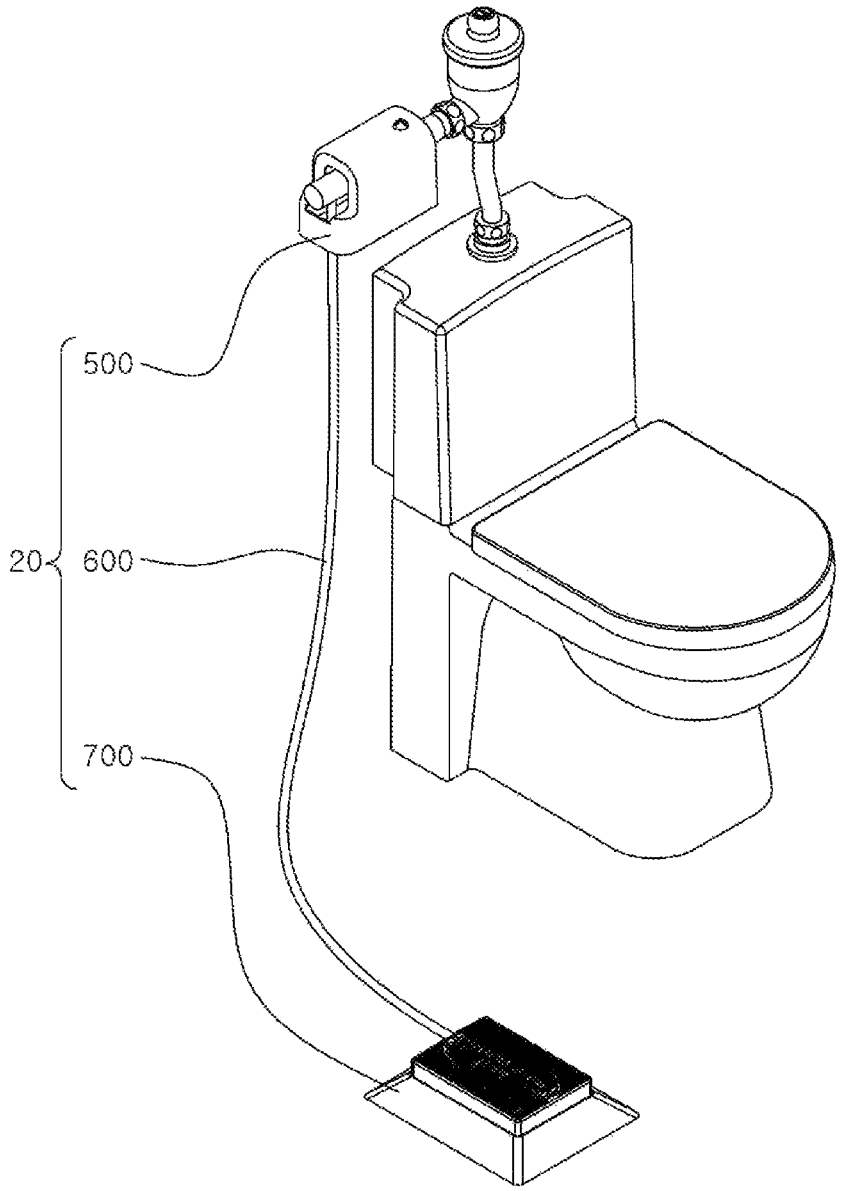
FIG. 8 is an exemplary view of a toilet bowl provided with a foot switch according to a second embodiment of the present device.

FIG. 8 is an exemplary view of a toilet bowl provided with a foot switch 20 according to a second embodiment of the present device. Referring to FIG. 8, the foot switch 20 according to the second embodiment of the present device may include a lever operating part 500, a driving cable 600, and a foot stepper 700.

Figure 9:
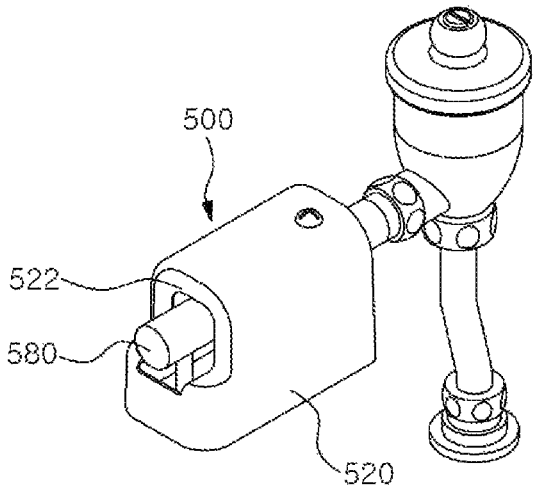
FIG. 9 is a perspective view of the lever operating part according to the second embodiment of the present device.

FIG. 9 is a perspective view of the lever operating part 500 according to the second embodiment of the present device. As shown in FIG. 9, the lever operating part 500 may include a housing 520, and a portion of a second frame 580 of the lever operating part 500 may be exposed to the outside through an opening 522 formed in the housing 520.

As will be described later, the second frame 580 is configured to rotate relative to a first frame 560 as the driving cable 600 is pulled. Because at least a portion of the second frame 580 is exposed to the outside through the opening 522 formed in the housing 520, a user may visually confirm whether the lever 3 is properly lowered by the foot stepper. In some cases, the user may operate the lever 3 by directly pressing the second frame 580 exposed to the outside.

Figure 10:
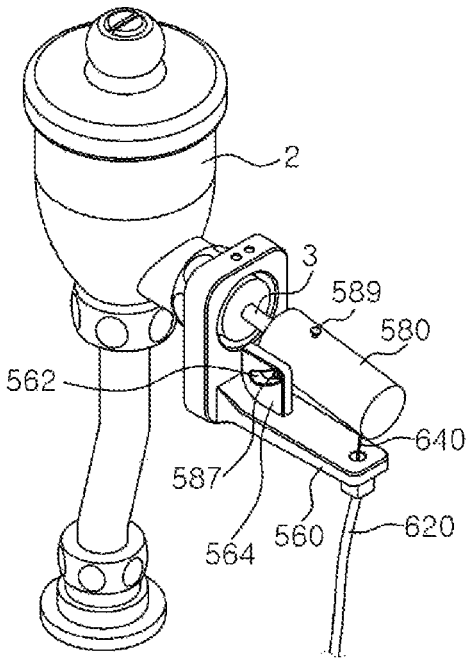
FIG. 10 is a perspective view of the lever operating part (from which a housing has been removed), according to the second embodiment of the present device.
Figure 11:
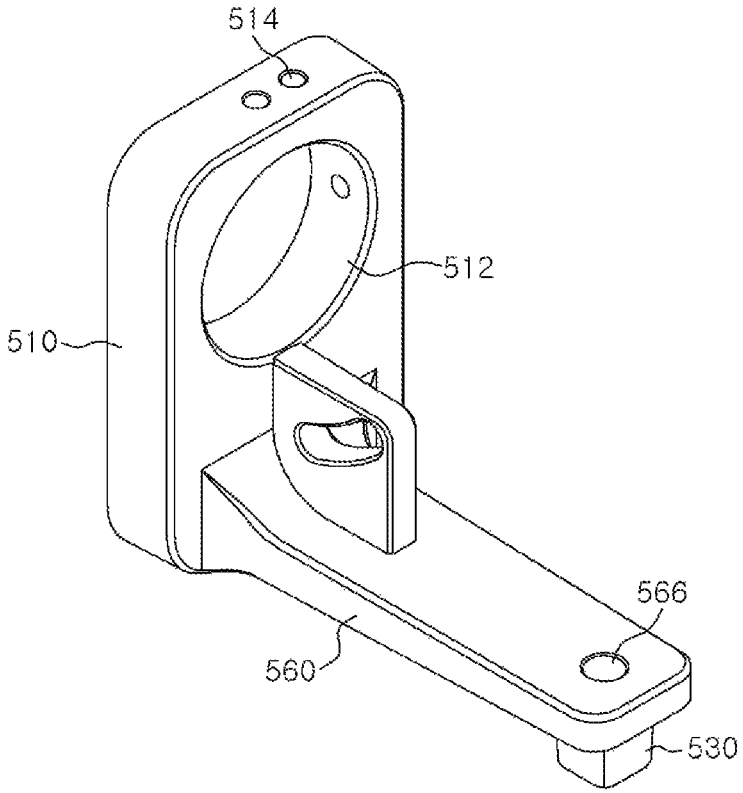
FIG. 11 is a perspective view of the lever operating part (from which a second frame has been removed), according to the second embodiment of the present device.

FIG. 10 is a perspective view of the lever operating part 500 (from which the housing 520 has been removed), according to the second embodiment of the present device. The lever operating part 500 includes the first frame 560 fixed to the flush valve 2, and the second frame 580 fixed to the lever 3. The second frame 580 may be configured to rotate relative to the first frame 560 as the driving cable 600 is pulled. FIG. 11 is a perspective view of the lever operating part 500 (from which the second frame 580 has been removed), according to the second embodiment of the present device.

As shown in FIG. 11, the lever operating part 500 may further include a first fixing member 510 for fixing the first frame 560 to the flush valve 2, and a second fixing member 530 for fixing an end of the driving cable 600 to the first frame 560.

The first fixing member 510 is integrally formed with the first frame 560 and may be, for example, a metal material having a predetermined strength. A hole 512 through and into which the flush valve 2 penetrates and is inserted may be formed in the fixing member 510. A plurality of fixing holes 514 may be formed around the hole 512. Accordingly, after the flush valve 2 is inserted into the hole 512 of the first fixing member 510, screws are fastened to the plurality of fixing holes 514 so that respective ends of the screws come into contact with the flush valve 2 and tighten the flush valve 2, and thus the first fixing member 510 and the first frame 560 integrally formed therewith may be fixed to the flush valve 2.

A hole 566 may be formed at an end of the first frame 560, and the second fixing member 530 may be integrally formed with the first frame 560 in the form of a hollow cylinder extending downward from the first frame 560. The hole 566 is also formed such that the second fixing member 530 penetrates through the hole 566.

The driving cable 600 has a double-track cable structure and may be composed of an inner cable 640 and an outer cable 620 surrounding the inner cable 640, and the outer cable 620 may be, for example, a sheathed wire. The inner cable 640 is movable within the outer cable 620. As shown in FIG. 10, the outer cable 620 may be fixedly fitted into a hollow of the second fixing member 530, and the inner cable 640 may further extend from the outer cable 620 and may be fixed to the second frame 580. Accordingly, when the inner cable 640 is pulled, the second frame 580 is rotated relative to the first frame 560.

Figure 12:
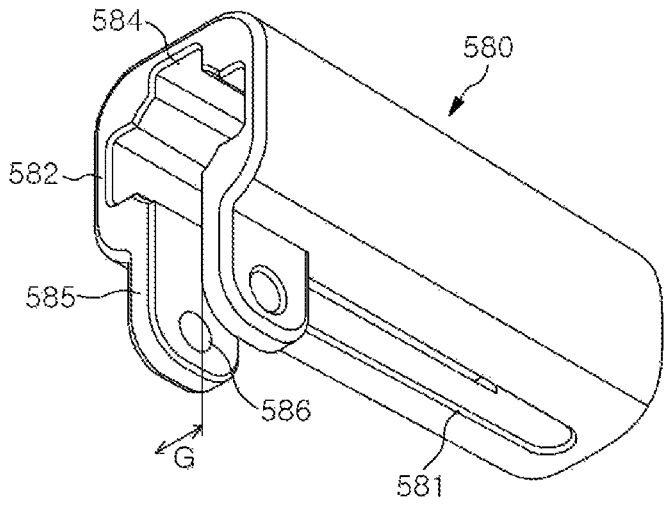
FIG. 12 is a perspective view of a second frame according to the second embodiment of the present device.
Figure 13:
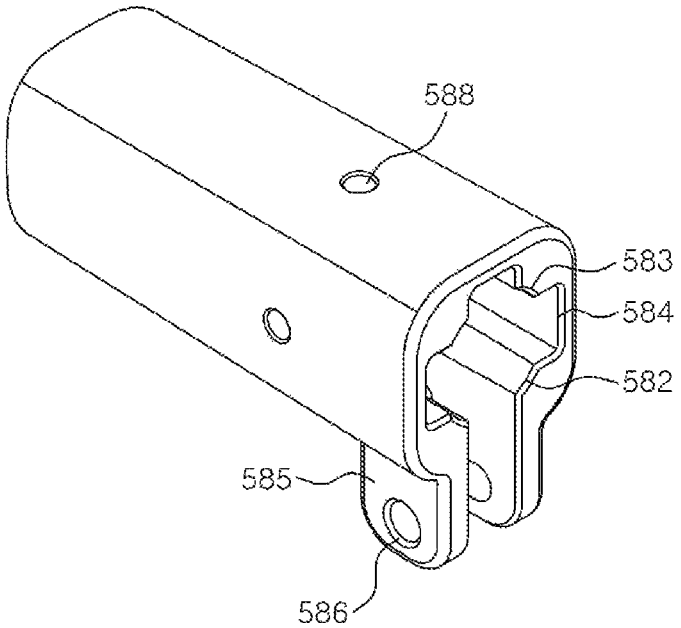
FIG. 13 is a perspective view of the second frame according to the second embodiment of the present device viewed at a different angle than an angle in FIG. 12.
Figure 14:
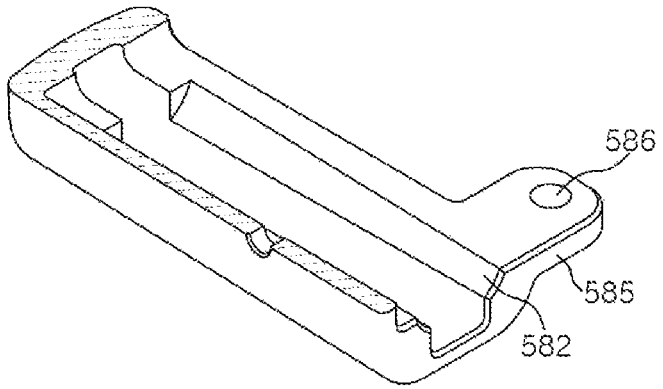
FIG. 14 is a cross-sectional perspective view of the second frame according to the second embodiment of the present device.

FIG. 12 is a perspective view of a second frame according to the second embodiment of the present device. FIG. 13 is a perspective view of the second frame according to the second embodiment of the present device viewed at a different angle than an angle in FIG. 12. FIG. 14 is a cross-sectional perspective view of the second frame according to the second embodiment of the present device. The second frame 580 wraps the lever 3 and is fixed to the lever 3. For example, the second frame 580 includes a lever hole 582 into which the lever 3 is inserted, and a coupling hole 584 formed along the periphery of the lever hole 582. Through these holes 582 and 584, the second frame 580 has an opening 583. The lever hole 582 and the coupling hole 584 each extend along a lengthwise direction of the second frame 580. The second frame 580 may be made of a synthetic resin that is slightly elastically deformable.

In order to ensure an operation of the lever 3, the lever 3 inserted into the second frame 580 may be tightly coupled with the second frame 580 so as not to be relatively moved within the second frame 580. In general, the lever 3 has a circular cross section, and its diameter increases as it extends in the lengthwise direction.

In consideration of this point, the lever hole 582 of the second frame 580 may be formed so that its diameter increases as the lever hole 582 extends in the longitudinal direction. Accordingly, as shown in FIG. 14, a width of a contact surface (contacting the lever 3) may be formed to increase as it extends in the lengthwise direction.

An opening 581 extending in the lengthwise direction may be formed in the second frame 580.

According to the above-described configuration, when the lever 3 is first inserted into the lever hole 582 of the second frame 580, the opening 583 of the second frame 580 may be wider due to presence of the opening 581 and the coupling hole 584, and thus the lever 3 may be inserted into the lever hole 582 of the second frame 580. In a state in which the lever 3 is completely inserted into the lever hole 582, the lever 3 may reach a state in which the lever 3 is tightly coupled within the lever hole 582.

Through guide pin coupling to be described later, a gap G between protrusions 585 may be reduced. Accordingly, in a state where a guide pin is coupled to a hole 586, the lever 3 may be more securely fixed within the lever hole 582.

In addition, a plurality of fixing holes 588 may be formed in the second frame 580. Accordingly, after the lever 3 is inserted into the hole 582 of the second frame 580, screws 589 are fastened to the plurality of fixing holes 588 so that respective ends of the screws 589 reach and press the lever 3, and thus an additional fixing force may be provided.

The second frame 580 has a pair of protrusions 585 each extending downward by being adjacent to the opening 583. A hole 586 is formed in each of the protrusions 585, and a guide pin is fixedly fitted into the hole 586. A thread may be formed at one end of the guide pin 587, and, as a bolt is fastened along the thread, the protrusions 585 approach each other, and as a result, the gap G between the protrusions 585 may be reduced.

According to the present device, when the inner cable 640 is pulled, the second frame 580 fixed to the lever 3 is rotated relative to the first frame 560 fixed to the flush valve 2, and thus the lever 3 is rotated.

Therefore, in order to stably rotate the second frame 580 relative to the first frame 560 with a relatively small force, the second frame 580 may maintain a state of being supported rotatably relative to the first frame 560.

The first frame 560 may additionally include a plate 564 in which a guide hole 562 is formed. When the second frame 580 is pulled by the inner cable 640 and rotated relative to the first frame 560, the guide pin 587 moves within the guide hole 562 and maintains a contact support state with the guide hole 562.

Figure 15:
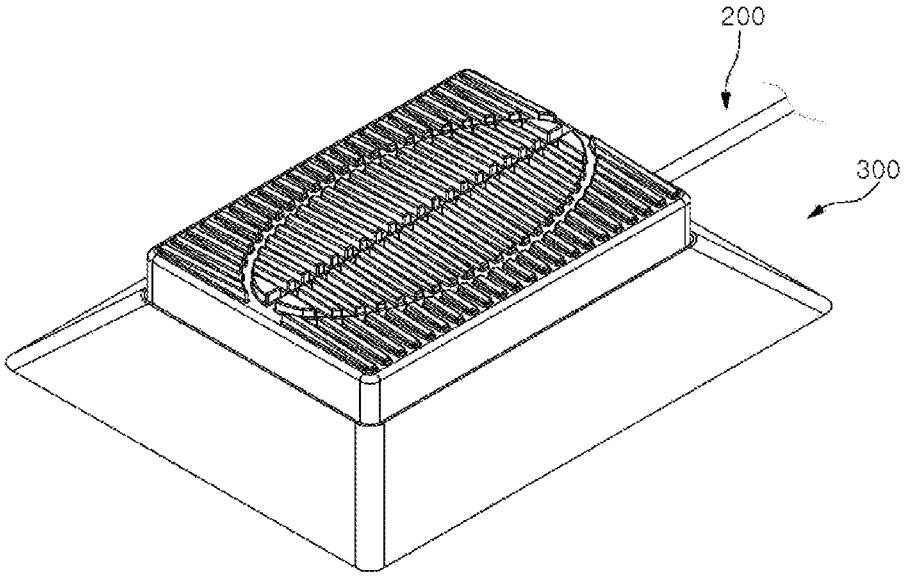
FIG. 15 is a perspective view of a foot stepper according to an embodiment of the present device.
Figure 16:
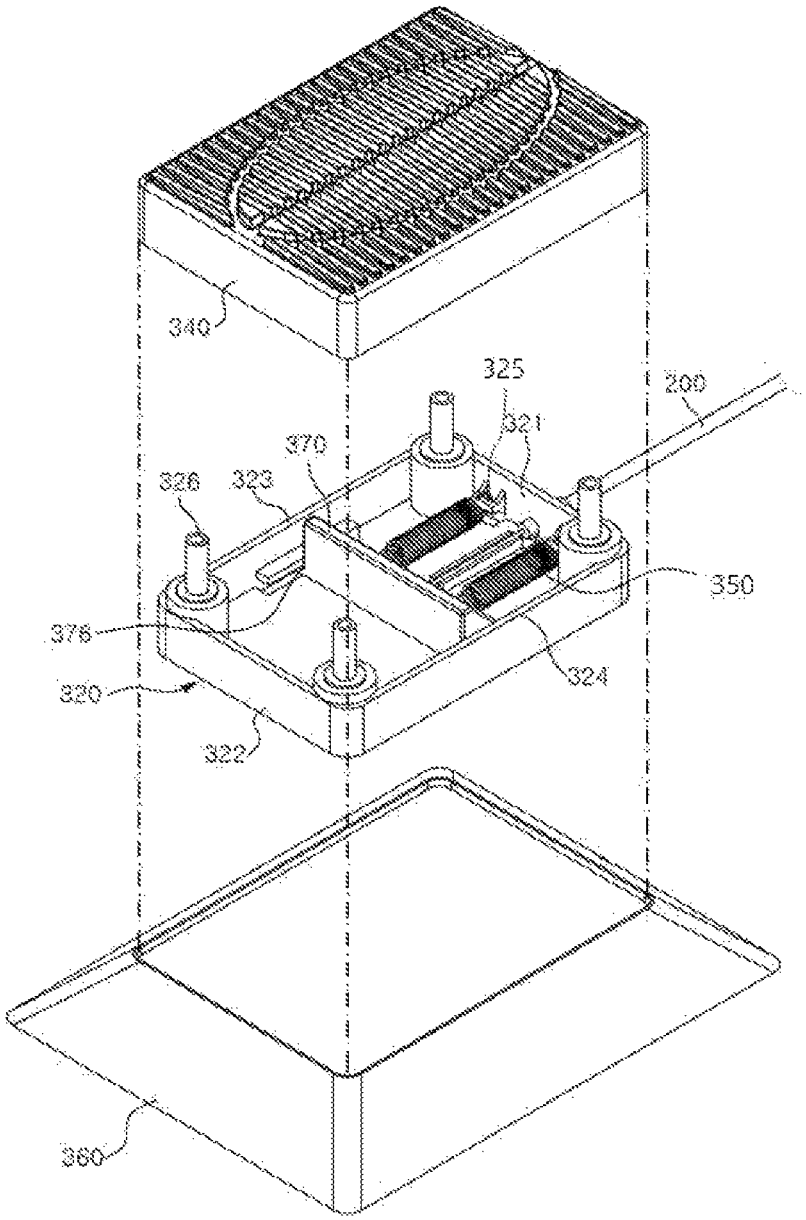
FIG. 16 is an exploded perspective view of the foot stepper according to an embodiment of the present device.

FIG. 15 is a perspective view of a foot stepper according to an embodiment of the present device. FIG. 16 is an exploded perspective view of the foot stepper according to an embodiment of the present device. A foot stepper 300 according to an embodiment of the present device includes a base plate 320, the pedal 340 disposed on the base plate 320, and an operating member 370 that is connected to the driving cable 200 for operating the lever 3 and slidably disposed in front and rear directions (F, R) of the base plate 320 within the base plate 320. In consideration of corrosion, the base plate 320, the operating member 370, and the pedal 340 may be manufactured by injection molding plastic.

In order to prevent the foot stepper 300 from being unintentionally turned over or easily moved on the floor surface of a public rest room while being used, the foot stepper 300 may additionally include a cradle 360. The cradle 360 may be designed to be larger toward the bottom so that a surface in contact with the floor increases. In order not to be easily moved, unlike the base plate 320, the cradle 360 may be made of stainless steel (which is relatively heavy compared to plastic).

Figure 17:
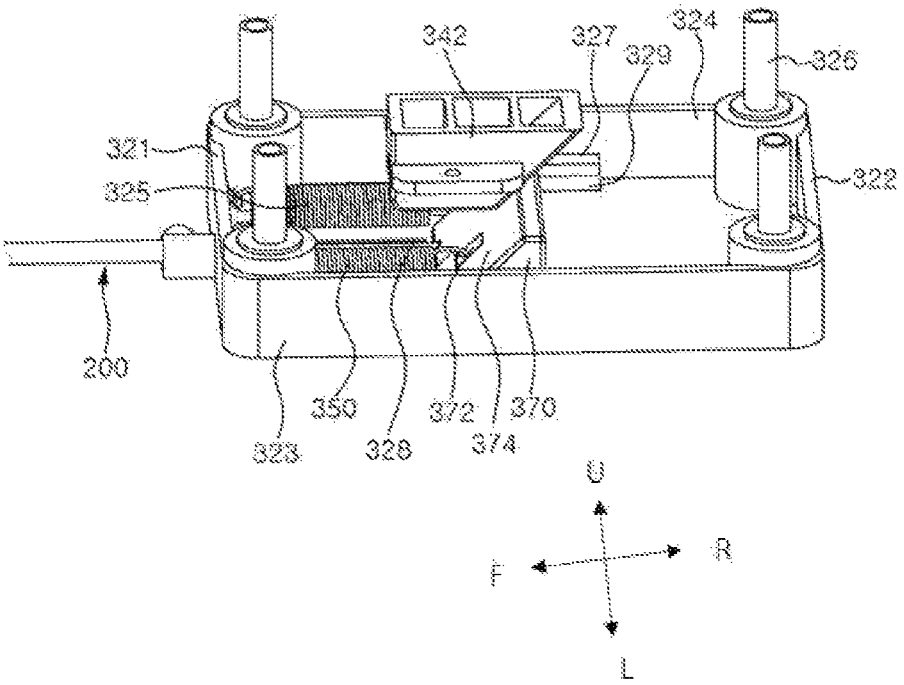
FIG. 17 is a perspective view of a base plate from which a pedal has been removed, according to an embodiment of the present device.

FIG. 17 is a perspective view of a base plate from which a pedal has been removed, according to an embodiment of the present device. However, for the purpose of explanation, a portion of the protrusion 342 formed on a lower surface of the pedal 340 is also shown in FIG. 17.

As shown in FIGS. 16 and 17, the base plate 320 includes an edge portion extending along its edge to form an inner space. The edge portion includes a front edge portion 321, a rear edge portion 322, and side edge portions 323 and 324 connecting the front edge portion 321 to the rear edge portion 322. A plurality of springs 350 may be disposed between the front edge portion 321 and the operating member 370. A hook portion 325 may be formed on the front edge portion 321, a groove 372 may be formed on a seating surface 374 of the operating member 370, and both ends of each of the springs 350 may be fitted onto the hook portion 325 and the groove 372, respectively, and thus the spring 350 may be connected to the front edge portion 321 and the operating member 370.

Figure 18:
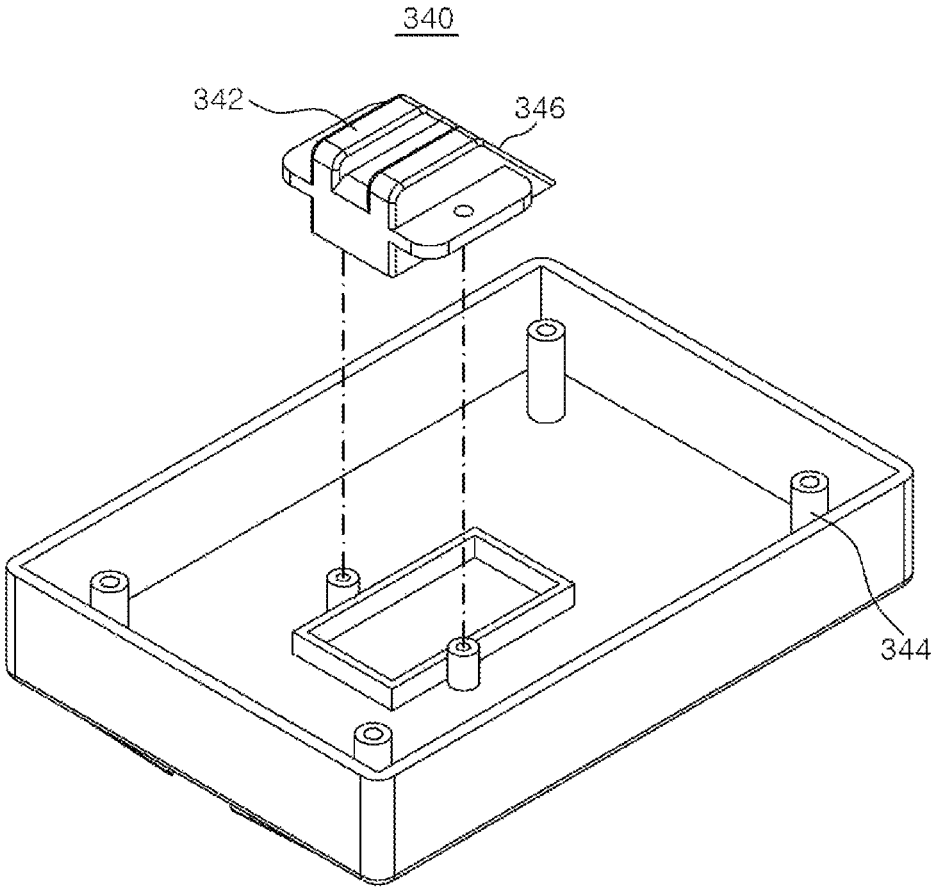
FIG. 18 is a perspective view of a pedal viewed so that a bottom of the pedal is exposed, according to an embodiment of the present device.

FIG. 18 is a perspective view of a pedal viewed so that a bottom of the pedal is exposed, according to an embodiment of the present device. As shown in FIG. 18, a protrusion 342 may be coupled to the lower surface of the pedal 340 through a screw.

Referring to FIG. 17, the operating member 370 includes the seating surface 364 in contact with the protrusion 342. As a user steps on the pedal 340 with his or her foot and accordingly the pedal 340 is pressed downward L, the protrusion 342 (together with the pedal 340) moves downward L. Because the seating surface 374 of the operating member 370 is inclined in the front and rear directions (F, R), the protrusion 342 pushes the operating member 370 rearward R while moving downward L. As the operating member 370 is pushed rearward R, a driving cable (more precisely, the inner cable 240) connected to the operating member 370 is pulled.

When the user removes the foot from the pedal 340 and thus a force applied to the pedal 340 is removed, a restoring force of the spring 350 and the lever 3 return to their original positions, and thus the operating member 370 is moved forward F by a force of pulling the driving cable 200, and, accordingly, while the protrusion 342 is moving upward U along the seating surface 374 of the operating member 370, the pedal 340 returns to its original location. Preferably, the protrusion 342 may have a seating surface 346 inclined at an inclination angle corresponding to the inclination angle of the seating surface 374 of the operating member 370. Accordingly, stable surface contact between the protrusion 342 and the operating member 370 is possible.

Through the above-described structure, an overall height of the foot stepper 300 may be adjusted. For example, a length of the inner cable 240 that needs to be pulled to drain water according to the existing flush valve 2 is determined. In other words, a distance by which the operating member 370 needs to move rearward R is determined according to the existing flush valve 2, and this distance is proportional to a downward (L) moving distance of the pedal 340, but the proportion varies according to the inclination angle of the seating surface 374 of the operating member 370 with respect to the bottom surface of the base plate 320. When the inclination angle of the seating surface 374 of the operating member 370 with respect to the bottom surface of the base plate 320 is set to be small, the operating member 370 further moves rearward R according to the downward (L) movement of the pedal 340. Accordingly, an overall height of the foot stepper 300 in a state where the user does not step on the pedal 340 is kept low, and accordingly, the foot stepper 300 may be miniaturized.

The pedal 340 may include a guide pin 344 extending downward L at every corner of its lower surface, and the base plate 320 may include a guide hole 326 in a cylindrical shape into which the guide pin 344 is inserted, at every corner of its upper surface. Because the guide hole 326 has a sufficiently great length, the pedal 340 is moved in a vertical direction (U, L) while the guide pin 344 is being inserted into the guide hole 326, and accordingly, a movement of the pedal 340 in the vertical direction (U, L) is stably guided. Through this structure, for example, a hinge-type structure such as a pedal of a car may be a burden on the ankle. However, the pedal 340 according to an embodiment of the present device is entirely moved in a vertical direction by being pressed by a user, and thus a lever may be sufficiently driven even with a relatively small force.

In addition, a guide portion 327 for guiding sliding of the operating member 370 in the forward and backward directions (F, R) is formed on at least a portion of the side edge portions 323 and 324, and a stopping protrusion 376 to be guided along the guide portion 327 is formed on a side surface of the operating member 370. Accordingly, a movement of the operating member 370 in the forward and backward directions (F, R) is stably guided.

A groove 328 for fixing the driving cable 200 may be formed on the bottom of the base plate 320. For example, the outer cable 220 may be fitted onto the groove 328 by force fitting and be fixed to the groove 328. The inner cable 240 is connected to the operating member 370. Accordingly, according to the rearward (R) movement of the operating member 370, the inner cable 240 is pulled.

Because the foot stepper 300 is disposed on the floor of a public rest room that needs to be cleaned frequently, the foot stepper 300 is frequently exposed to water. Accordingly, at least one drain hole 329 is formed in the bottom of the base plate 320. Therefore, water which unintentionally permeates into the inner space of the foot stepper 300 is discharged to the outside through the drain hole 329.

DESCRIPTION OF REFERENCE NUMERALS

2: flush valve
3: lever

10: foot switch
100: lever operating part
120: housing
140: arm
150: protrusion pin
160: frame
170: rotation axis
200: driving cable
300: foot stepper
340: pedal

What is claimed is:

1. A foot switch for driving a lever-type flush valve of a toilet bowl, the foot switch comprising:

a lever operating part mounted on a flush valve of a toilet bowl to rotate a lever of the flush valve;

a driving cable of which one end is connected to the lever operating part and the other end is connected to a foot stepper; and the foot stepper configured to pull the driving cable by being pressed by a foot of a user, wherein the lever operating part comprises a first frame fixed to the flush valve and a second frame configured to be supported to be rotatable relative to the first frame as the driving cable is pulled, wherein the second frame is configured to wrap the lever and be fixed to the lever, the second frame is configured to rotate relative to the first frame as the driving cable is pulled, and the second frame is rotated to rotate the lever fixed to the second frame, and wherein:

the second frame includes a lever hole forming an opening into which the lever is inserted, and a coupling hole formed along a periphery of the opening, and each of the lever hole and the coupling hole extends along a lengthwise direction of the second frame.

2. The foot switch of claim 1, wherein the second frame is an arm, the arm is configured to rotate relative to the first frame as the driving cable is pulled, and the arm is rotated to contact the lever to push and rotate the lever.

3. The foot switch of claim 2, wherein the lever operating part comprises a housing at least partially surrounding the first frame and the second frame, and the housing has a lower portion that is open to be mounted on the flush valve from top to bottom.

4. The foot switch of claim 3, wherein the arm is located inside the housing in a state where the driving cable is not pulled, and the arm protrudes from the housing as the driving cable is pulled and the arm is rotated, the housing comprises a guide groove, as the arm rotates, the arm moves along the guide groove, the housing comprises a lever groove enabling the lever to protrude out of the housing, and respective lower portions of the guide groove and the lever groove are opened.

5. The foot switch of claim 1, wherein an opening extending in a lengthwise direction is formed in the second frame.

6. The foot switch of claim 1, wherein the driving cable includes an inner cable and an outer cable surrounding the inner cable, and the inner cable is movable within the outer cable, and the inner cable is connected to the second frame so that the second frame is rotated as the inner cable is pulled.

7. The foot switch of claim 1, wherein the lever operating part further comprises a housing, and at least a portion of the second frame is exposed to the outside through an opening formed in the housing so that a user operates the lever by pressing the second frame.

8. The foot switch of claim 1, wherein the foot stepper comprises:

a base plate;

a pedal seated on the base plate; and an operating member connected to the driving cable and slidably disposed in front and rear directions of the base plate within the base plate, and as the pedal is pressed downward, a protrusion formed on a lower surface of the pedal moves downward and comes into contact with a seating surface of the operating member to push the operating member in the front and rear directions.

9. A foot switch for driving a lever-type flush valve of a toilet bowl, the foot switch comprising:

a lever operating part mounted on a flush valve of a toilet bowl to rotate a lever of the flush valve;

a driving cable of which one end is connected to the lever operating part and the other end is connected to a foot stepper; and the foot stepper configured to pull the driving cable by being pressed by a foot of a user, wherein the lever operating part comprises a first frame fixed to the flush valve and a second frame configured to be supported to be rotatable relative to the first frame as the driving cable is pulled, wherein the second frame is configured to wrap the lever and be fixed to the lever, the second frame is configured to rotate relative to the first frame as the driving cable is pulled, and the second frame is rotated to rotate the lever fixed to the second frame, and wherein a diameter of a lever hole increases in a direction away from an opening into which the lever is inserted in a lengthwise direction of the second frame.

10. A foot switch for driving a lever-type flush valve of a toilet bowl, the foot switch comprising:

a lever operating part mounted on a flush valve of a toilet bowl to rotate a lever of the flush valve;

a driving cable of which one end is connected to the lever operating part and the other end is connected to a foot stepper; and the foot stepper configured to pull the driving cable by being pressed by a foot of a user, wherein the lever operating part comprises a first frame fixed to the flush valve and a second frame configured to be supported to be rotatable relative to the first frame as the driving cable is pulled, wherein the second frame is configured to wrap the lever and be fixed to the lever, the second frame is configured to rotate relative to the first frame as the driving cable is pulled, and the second frame is rotated to rotate the lever fixed to the second frame, and wherein the second frame comprises a pair of protrusions each extending downward adjacent to an opening into which the lever is inserted, and a hole is formed in each of the protrusions, and a guide pin is fixedly fitted into the hole.

11. The foot switch of claim 10, wherein the first frame comprises a guide hole, and, when the second frame is pulled by the driving cable and rotated relative to the first frame, the guide pin moves within the guide hole and maintains a contact support state with the guide hole.

* * * * *